US008121850B2

(12) United States Patent
Yamanashi et al.

(10) Patent No.: US 8,121,850 B2
(45) Date of Patent: Feb. 21, 2012

(54) ENCODING APPARATUS AND ENCODING METHOD

(75) Inventors: Tomofumi Yamanashi, Kanagawa (JP); Kaoru Sato, Kanagawa (JP); Toshiyuki Morii, Kanagawa (JP)

(73) Assignee: Panasonic Corporation, Osaka (JP)

( * ) Notice: Subject to any disclaimer, the term of this patent is extended or adjusted under 35 U.S.C. 154(b) by 652 days.

(21) Appl. No.: 12/299,976

(22) PCT Filed: May 9, 2007

(86) PCT No.: PCT/JP2007/059582

§ 371 (c)(1),
(2), (4) Date: Nov. 7, 2008

(87) PCT Pub. No.: WO2007/129728

PCT Pub. Date: Nov. 15, 2007

(65) Prior Publication Data

US 2009/0171673 A1 Jul. 2, 2009

(30) Foreign Application Priority Data

May 10, 2006 (JP) ..... 2006-131852
Feb. 27, 2007 (JP) ..... 2007-047931

(51) Int. Cl.
*G10L 19/00* (2006.01)

(52) U.S. Cl. ..... 704/501; 704/500; 704/503; 704/504; 704/205; 704/206

(58) Field of Classification Search ..... 704/501, 704/500, 205, 206, 503, 504
See application file for complete search history.

(56) References Cited

U.S. PATENT DOCUMENTS 6,640,209 B1 * 10/2003 Das ..... 704/219
6,680,972 B1 1/2004 Liljeryd et al.
6,925,116 B2 8/2005 Liljeryd et al.
7,283,955 B2 10/2007 Liljeryd et al.
7,328,162 B2 2/2008 Liljeryd et al.
7,752,052 B2 * 7/2010 Oshikiri ..... 704/500

(Continued)

FOREIGN PATENT DOCUMENTS

JP 08-263096 A 10/1996

(Continued)

OTHER PUBLICATIONS

Ramprashad, "a Two Stage Hybrid Embedded Speech/Audio Coding Structure," Acoustics, Speech and Signal Processing, 1998, Proceedings of the 1998 IEEE International Conference on, Seattle, WA, USA, May 12-15, 1998, pp. 337-340, XP010279163.

(Continued)

*Primary Examiner* — Qi Han
(74) *Attorney, Agent, or Firm* — Greenblum & Bernstein, P.L.C.

(57) ABSTRACT

An encoding device and an encoding method are provided for encoding by reducing the number of samples to be processed when encoding higher-band spectrum data according to lower-band spectrum data in a wide-band signal. The device and the method can obtain a high-quality decoded signal even if a large quantization distortion is caused in the lower-band spectrum data. When encoding higher-band spectrum data in a signal to be encoded, according to lower-band spectrum data in the signal, only for a part (a head portion) of the higher-band spectrum data, the lower-band spectrum data after being quantized is subjected to approximate partial search and higher-band spectrum data is generated according to the search result.

9 Claims, 9 Drawing Sheets

U.S. PATENT DOCUMENTS

| | | | | |
|---|---|---|---|---|
| 2003/0088423 | A1 * | 5/2003 | Nishio et al. | 704/500 |
| 2003/0093271 | A1 | 5/2003 | Tsushima et al. | |
| 2003/0142746 | A1 | 7/2003 | Tanaka et al. | |
| 2004/0078194 | A1 | 4/2004 | Liljeryd et al. | |
| 2004/0078205 | A1 | 4/2004 | Liljeryd et al. | |
| 2004/0125878 | A1 | 7/2004 | Liljeryd et al. | |
| 2004/0247037 | A1 | 12/2004 | Honma et al. | |
| 2007/0299669 | A1 | 12/2007 | Ehara | |
| 2008/0027733 | A1 | 1/2008 | Oshikiri et al. | |
| 2008/0052066 | A1 | 2/2008 | Oshikiri et al. | |

FOREIGN PATENT DOCUMENTS

| | | | |
|---|---|---|---|
| JP | 2001-521648 | A | 11/2001 |
| JP | 2003-140692 | A | 5/2003 |
| JP | 2003-216190 | A | 7/2003 |
| JP | 2004-004530 | A | 1/2004 |
| JP | 2004-080635 | A | 3/2004 |
| WO | WO-03/091989 | A1 * | 11/2003 |
| WO | WO 2005/111568 | A1 | 11/2005 |

OTHER PUBLICATIONS

Grill, "A bit rate scalable perceptual coder for MPEG-4 audio," Audio Engineering Society, Convention Preprint, Sep. 26, 1997, XP002302435.

English language Abstract of JP 2003-140692 A, May 16, 2003.

U.S. Appl. No. 11/994,140 to Takuya Kawashima et al., entitled "Scalable Decoder and Disappeared Data Interpolating Method," and International Application filed Jun. 27, 2006.

U.S. Appl. No. 12/088,300 to Masahiro Oshikiri, entitled "Speech Encoding Apparatus and Speech Encoding Method," and International Application filed Sep. 29, 2006.

* cited by examiner

ENCODING APPARATUS AND ENCODING METHOD

TECHNICAL FIELD

The present invention relates to a encoding apparatus and encoding method used in a communication system for encoding and transmitting signals.

BACKGROUND ART

When speech/sound signals are transmitted in a packet communication system represented by Internet communication, mobile communication system and so on, compression/coding techniques are often used to improve the transmission efficiency of speech/sound signals. Furthermore, in the recent years, while speech/sound signals are being encoded simply at low bit rates, there is a growing demand for techniques for encoding speech/sound signals of wider band.

To meet this demand, studies are underway to develop various techniques for encoding wideband speech/sound signals without drastically increasing the amount of encoded information. For example, patent document 1 discloses a technique of generating features of the high frequency band region in the spectral data obtained by converting an input acoustic signal of a certain period, as side information, and outputting this information together with encoded information of the low band region. To be more specific, the spectral data of the high frequency band region is divided into a plurality of groups, and, in each group, regards the spectrum of the low band region that is the most similar to the spectrum of the group, as the side information mentioned above.

Furthermore, patent document 2 discloses a technique of dividing the high band signal into a plurality of subbands, deciding, per subband, the degree of similarity between the signal of each subband and the low band signal, and changing the configurations of side information (i.e. the amplitude parameter of the subband, position parameter of a similar low band signal, residual signal parameter between the high band the and the low band) according to the decision result.

Patent Document 1: Japanese Patent Application Laid-Open No. 2003-140692

Patent Document 2: Japanese Patent Application Laid-Open No. 2004-004530

DISCLOSURE OF INVENTION

Problems to be Solved by the Invention

However, although the techniques disclosed in above-described patent document 1 and patent document 2 decide a low band signal that correlates with or that is similar to a high band region to generate a high band signal (i.e. spectral data of a high band region), this is performed per subband (group) of the high band signal, and, as a result, the amount of processing of calculations becomes enormous. Furthermore, since the above-described processing is carried out on a per band basis, not only the amount of calculation, but also the amount of information required to encode side information increases.

Furthermore, the techniques disclosed in above-described patent document 1 and patent document 2 decide the degree of similarity of spectral data of the high band region of an input signal in the same way as spectral data of the low band region of the input signal, and, given that spectral data of the low band region is not taken into account if it is distorted by quantization, a severe sound quality degradation is anticipated when spectral data of the low band region is distorted by quantization.

It is therefore an object of the present invention to provide an encoding apparatus and encoding method that make it possible to encode spectral data of the high band region of a wideband signal based on spectral data of the low band region of the signal by reducing the number of samples to be processed and furthermore obtain a decoded signal of high quality even when a severe quantization distortion occurs in the spectral data of the low band region.

Means for Solving the Problem

The encoding apparatus of the present invention adopts a configuration including: a first encoding section that encodes an input signal to generate first encoded information; a decoding section that decodes the first encoded information to generate a decoded signal; a orthogonal transform section that orthogonal-transforms the input signal and the decoded signal to generate orthogonal transform coefficients for the signals; a second encoding section that generates second encoded information representing a high band part in the orthogonal transform coefficients of the decoded signal, based on the orthogonal transform coefficients of the input signal and the orthogonal transform coefficients of the decoded signal; and an integration section that integrates the first encoded information and the second encoded information.

The encoding method of the present invention includes: a first encoding step of encoding an input signal to generate first encoded information; a decoding step of decoding the first encoded information to generate a decoded signal; a orthogonal transform step of orthogonal-transforming the input signal and the decoded signal to generate orthogonal transform coefficients for the signals; a second encoding step of generating second encoded information representing a high band part of the orthogonal transform coefficients of the decoded signal based on the orthogonal transform coefficients of the input signal and the orthogonal transform coefficients of the decoded signal; and an integration step of integrating the first encoded information and the second encoded information.

Advantageous Effect of the Invention

In accordance with the present invention, it is possible to encode spectral data of the high band region of a wideband signal based on spectral data of the low band region of the wideband signal by reducing the number of samples to be processed and furthermore obtain a decoded signal of high quality even when a severe quantization distortion occurs in the spectral data of the low band region.

BEST MODE FOR CARRYING OUT THE INVENTION

Embodiments of the present invention will be explained below in detail with reference to the accompanying drawings.

Embodiment 1

Figure 1:
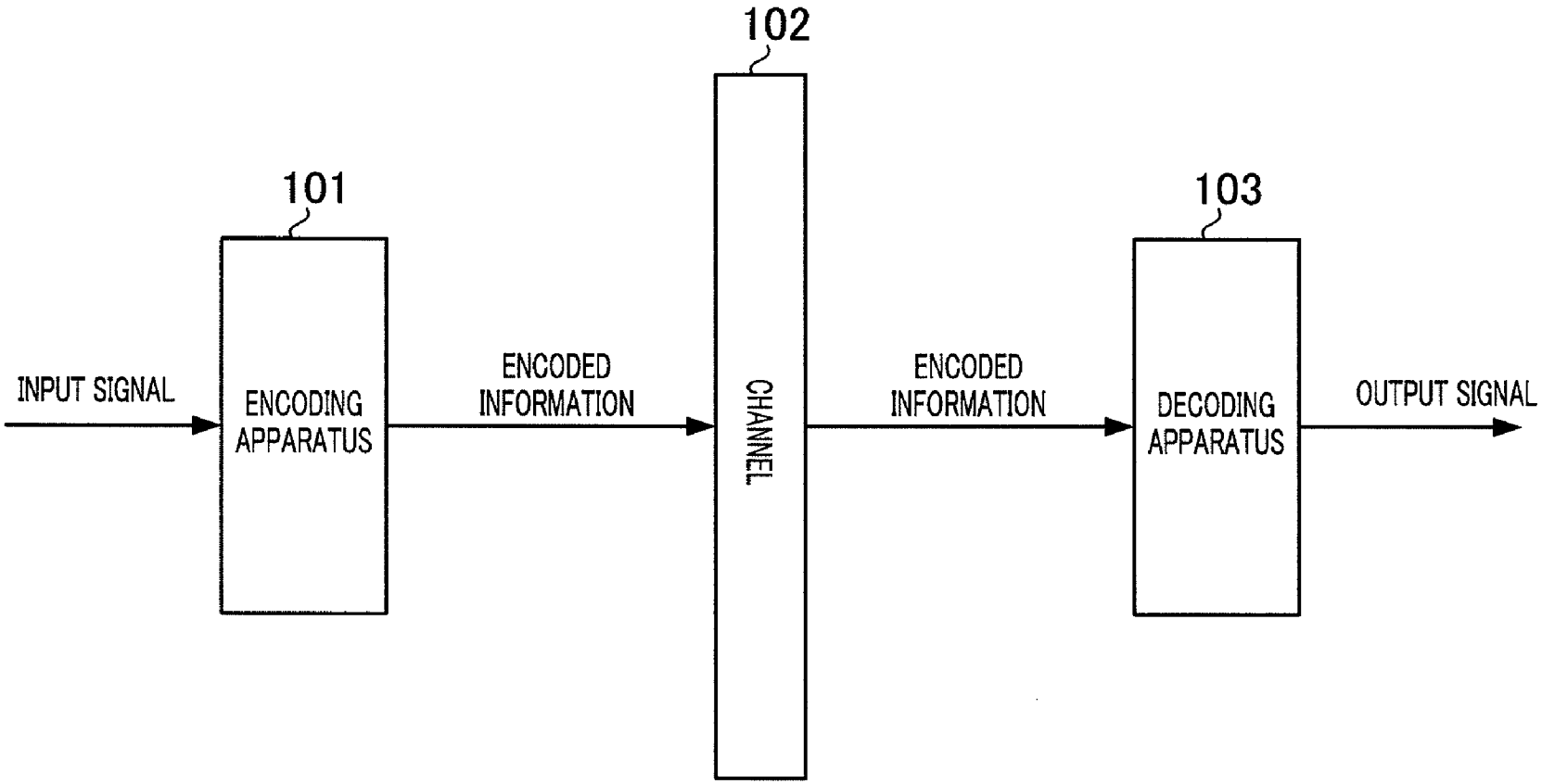
FIG. 1 is a block diagram showing a configuration of a communication system provided with a encoding apparatus and decoding apparatus according to Embodiments 1 and 2 of the present invention.

FIG. 1 is a block diagram showing a configuration of a communication system with a encoding apparatus and decoding apparatus according to Embodiment 1 of the present invention. In FIG. 1, the communication system is provided with a encoding apparatus and decoding apparatus, which are able to communicate with each other via a channel. The channel may be wireless or wired or may be both wireless and wired.

Encoding apparatus 101 divides an input signal every N samples (N is a natural number), regards N samples one frame, and performs encoding per frame. Here, suppose the input signal to be encoded is expressed as "$x_n$" (n=0, . . . , N−1). n indicates the (n+1)-th signal element of the input signal divided every N samples. The encoded input information (i.e. encoded information) is transmitted to decoding apparatus 103 via channel 102.

Decoding apparatus 103 receives the encoded information transmitted from encoding apparatus 101 via channel 102, decodes the signal and obtains an output signal.

Figure 2:
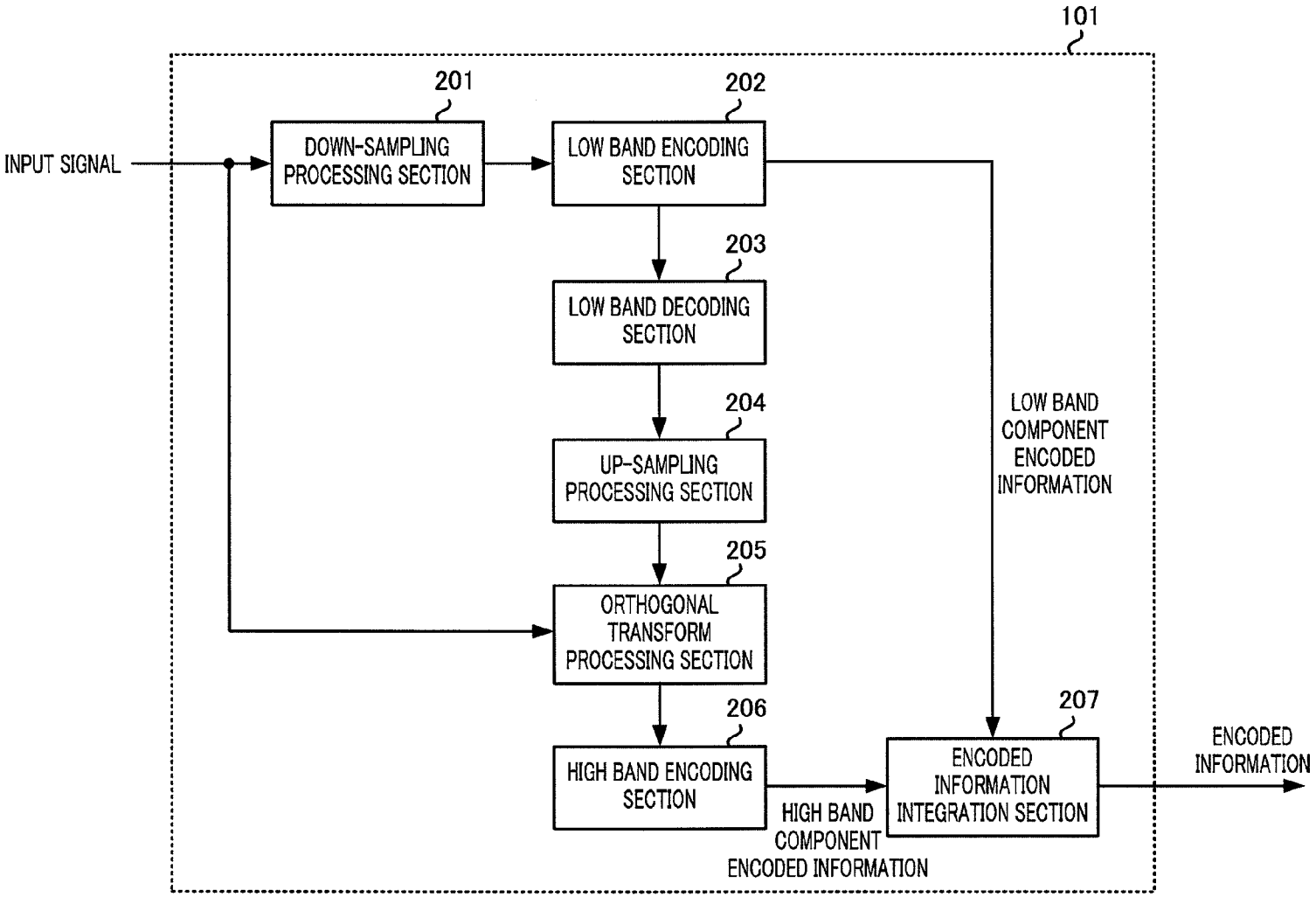
FIG. 2 is a block diagram showing a configuration of the encoding apparatus shown in FIG. 1.

FIG. 2 is a block diagram showing an internal configuration of encoding apparatus 101 shown in FIG. 1. When the sampling frequency of the input signal is $SR_{input}$, down-sampling processing section 201 down-samples the sampling frequency of the input signal from $SR_{input}$ to $SR_{base}$ ($SR_{base}<SR_{input}$), and outputs the down-sampled input signal to low band encoding section 202 as the down-sampled input signal.

Low band encoding section 202 encodes the down-sampled input signal outputted from down-sampling processing section 201 using a CELP type speech encoding method, to generate a low band component encoded information, and outputs the low band component encoded information generated, to low band decoding section 203 and encoded information integration section 207. The details of low band encoding section 202 will be described later.

Low band decoding section 203 decodes the low band component encoded information outputted from low band encoding section 202 using a CELP type speech decoding method, to generate a low band component decoded signal, and outputs the low band component decoded signal generated, to up-sampling processing section 204. The details of low band decoding section 203 will be described later.

Up-sampling processing section 204 up-samples the sampling frequency of the low band component decoded signal outputted from low band decoding section 203 from $SR_{base}$ to $SR_{input}$, and outputs the up-sampled low band component decoded signal to orthogonal transform processing section 205 as the up-sampled low band component decoded signal.

Orthogonal transform processing section 205 contains buffers buf $\mathbf{1}_n$ and buf $\mathbf{2}_n$ (n=0, . . . , N−1) in association with the aforementioned signal elements, and initializes the buffers using 0 as the initial value according to equation 1 and equation 2, respectively.

(Equation 1)

$$buf1_n=0(n=0, \ldots, N-1) \quad [1]$$

(Equation 2)

$$buf2_n=0\ (n=0, \ldots, N-1) \quad [2]$$

Next, as for the orthogonal transform processing in orthogonal transform processing section 205, the calculation procedures and data output to the internal buffers will be explained.

Orthogonal transform processing section 205 applies the modified discrete cosine transform ("MDCT") to input signal $x_n$ and up-sampled low band component decoded signal $y_n$ outputted from up-sampling processing section 204 and calculates MDCT coefficients $X_k$ of the input signal and MDCT coefficients $Y_k$ of up-sampled low band component decoded signal $y_n$ according to equation 3 and equation 4.

(Equation 3)

$$X_k = \frac{2}{N}\sum_{n=0}^{2N-1} x'_n \cos\left[\frac{(2n+1+N)(2k+1)\pi}{4N}\right](k=0, \ldots, N-1) \quad [3]$$

(Equation 4)

$$Y_k = \frac{2}{N}\sum_{n=0}^{2N-1} y'_n \cos\left[\frac{(2n+1+N)(2k+1)\pi}{4N}\right](k=0, \ldots, N-1) \quad [4]$$

Here, k is the index of each sample in a frame. Orthogonal transform processing section 205 calculates $x_n'$, which is a vector combining input signal $x_n$ and buffer buf $\mathbf{1}_n$, according to following equation 5. Furthermore, orthogonal transform processing section 205 calculates which is a vector combining up-sampled low band component decoded signal $y_n$ and buffer buf $\mathbf{2}_n$, according to following equation 6.

(Equation 5)

$$x'_n \begin{cases} buf1_n & (n=0, \ldots N-1) \\ x_{n-N} & (n=N, \ldots 2N-1) \end{cases} \quad [5]$$

(Equation 6)

$$y'_n \begin{cases} buf2_n & (n=0, \ldots N-1) \\ y_{n-N} & (n=N, \ldots 2N-1) \end{cases} \quad [6]$$

Next, orthogonal transform processing section 205 updates buffers buf $\mathbf{1}_n$ and buf $\mathbf{2}_n$ according to equation 7 and equation 8.

(Equation 7)

$$buf1_n=x_n\ (n=0, \ldots N-1) \quad [7]$$

(Equation 8)

$$buf2_n=y_n\ (n=0, \ldots N-1) \quad [8]$$

Orthogonal transform processing section 205 outputs the MDCT coefficients $X_k$ of the input signal and MDCT coefficients $Y_k$ of the up-sampled low band component decoded signal, to high band encoding section 206.

High band encoding section 206 generates a high band component encoded information from the values of MDCT coefficients $X_k$ of the input signal outputted from orthogonal transform processing section 205 and MDCT coefficients $Y_k$ of the up-sampled low band component decoded signal, and outputs the high band component encoded information generated, to encoded information integration section 207. The details of high band encoding section 206 will be described later.

Encoded information integration section 207 integrates the low band component encoded information outputted from low band encoding section 202 with the high band component encoded information outputted from high band encoding section 206, adds, if necessary, a transmission error code and so on, to the integrated encoded information, and outputs the resulting code to channel 102 as encoded information.

Figure 3:
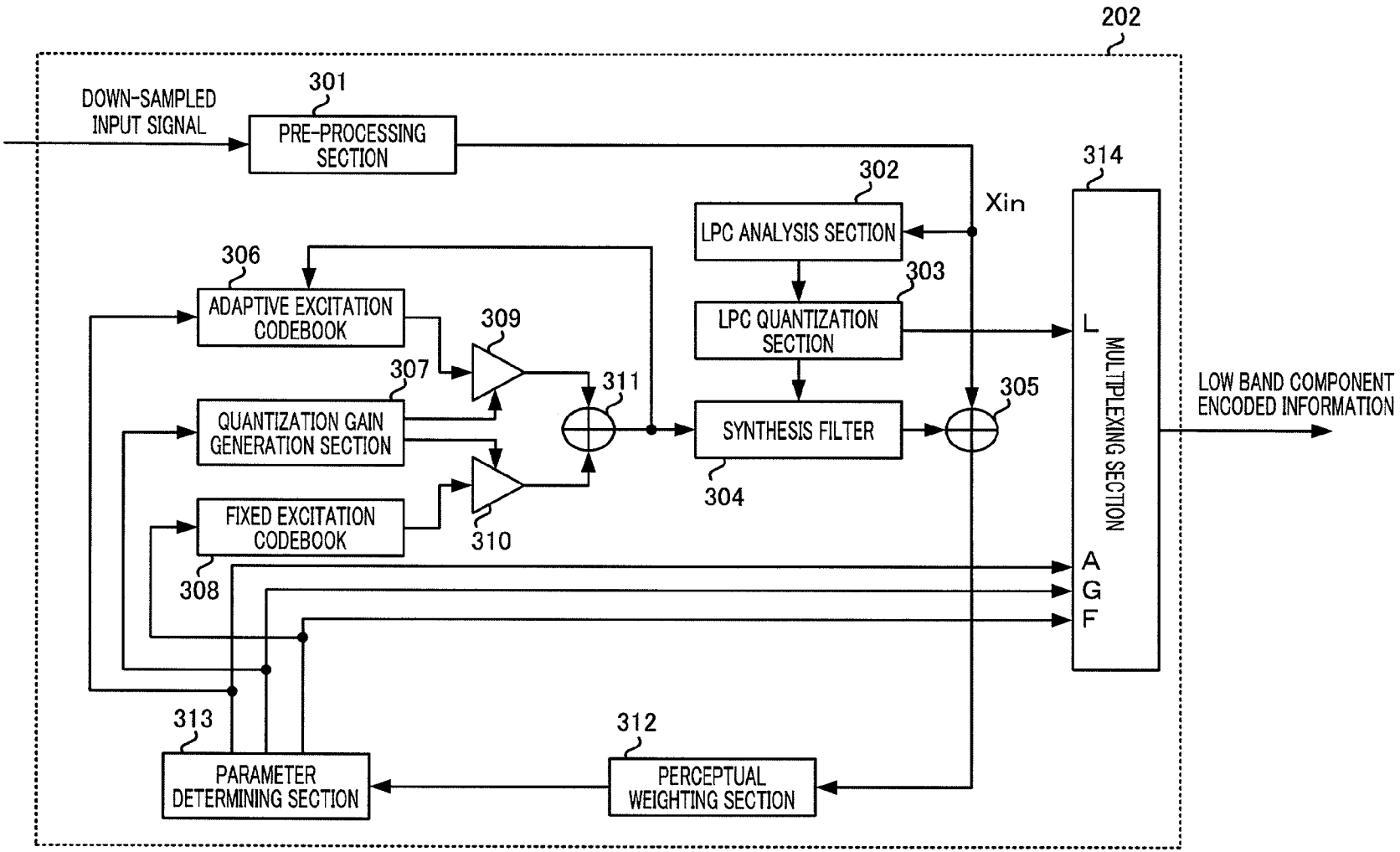
FIG. 3 is a block diagram showing an internal configuration of the low band encoding section shown in FIG. 2.

Next, the internal configuration of low band encoding section 202 shown in FIG. 2 will be explained using FIG. 3. Here, a case where low band encoding section 202 performs CELP type speech encoding, will be explained. Pre-processing section 301 performs high pass filter processing of removing the DC component, waveform shaping processing or pre-emphasis processing, with the input signal, to improve the performance of subsequent encoding processing, and outputs the signal (Xin) subjected to such processing to LPC analysis section 302 and addition section 305.

LPC analysis section 302 performs a linear predictive analysis using Xin outputted from pre-processing section 301, and outputs the analysis result (linear predictive analysis coefficient) to LPC quantization section 303.

LPC quantization section 303 performs quantization processing of the linear predictive coefficient (LPC) outputted from LPC analysis section 302, outputs the quantized LPC to synthesis filter 304 and also outputs a code (L) representing the quantized LPC, to multiplexing section 314.

Synthesis filter 304 performs a filter synthesis on an excitation outputted from addition section 311 (described later) using a filter coefficient based on the quantized LPC outputted from LPC quantization section 303, generates a synthesized signal and outputs the synthesized signal to addition section 305.

Addition section 305 inverts the polarity of the synthesized signal outputted from synthesis filter 304, adds the synthesized signal with an inverse polarity to Xin outputted from pre-processing section 301, thereby calculating an error signal, and outputs the error signal to perceptual weighting section 312.

Adaptive excitation codebook 306 stores excitation outputted in the past from addition section 311 in a buffer, extracts one frame of samples from the past excitation specified by the signal outputted from parameter determining section 313 (described later) as an adaptive excitation vector, and outputs this vector to multiplication section 309.

Quantization gain generation section 307 outputs a quantization adaptive excitation gain and quantization fixed excitation gain specified by the signal outputted from parameter determining section 313, to multiplication section 309 and multiplication section 310, respectively.

Fixed excitation codebook 308 outputs a pulse excitation vector having a shape specified by a signal outputted from parameter determining section 313, to multiplication section 310 as a fixed excitation vector. A vector produced by multiplying the pulse excitation vector by a spreading vector may also be outputted to multiplication section 310 as a fixed excitation vector.

Multiplication section 309 multiplies the adaptive excitation vector outputted from adaptive excitation codebook 306 by the quantization adaptive excitation gain outputted from quantization gain generation section 307, and outputs the multiplication result to addition section 311. Furthermore, multiplication section 310 multiplies the fixed excitation vector outputted from fixed excitation codebook 308 by the quantization fixed excitation gain outputted from quantization gain generation section 307, and outputs the multiplication result to addition section 311.

Addition section 311 adds up the adaptive excitation vector multiplied by the gain outputted from multiplication section 309 and the fixed excitation vector multiplied by the gain outputted from multiplication section 310, and outputs an excitation, which is the addition result, to synthesis filter 304 and adaptive excitation codebook 306. The excitation outputted to adaptive excitation codebook 306 is stored in the buffer of adaptive excitation codebook 306.

Perceptual weighting section 312 assigns perceptual a weight to the error signal outputted from addition section 305, and outputs the resulting error signal to parameter determining section 313 as the coding distortion.

Parameter determining section 313 selects the adaptive excitation vector, fixed excitation vector and quantization gain that minimize the coding distortion outputted from perceptual weighting section 312 from adaptive excitation codebook 306, fixed excitation codebook 308 and quantization gain generation section 307, respectively, and outputs an adaptive excitation vector code (A), fixed excitation vector code (F) and quantization gain code (G) showing the selection results, to multiplexing section 314.

Multiplexing section 314 multiplexes the code (L) showing the quantized LPC outputted from LPC quantization section 303, the adaptive excitation vector code (A), fixed excitation vector code (F) and quantization gain code (G) outputted from parameter determining section 313 and outputs the multiplexed code to low band decoding section 203 and encoded information integration section 207 as a low band component encoded information.

Figure 4:
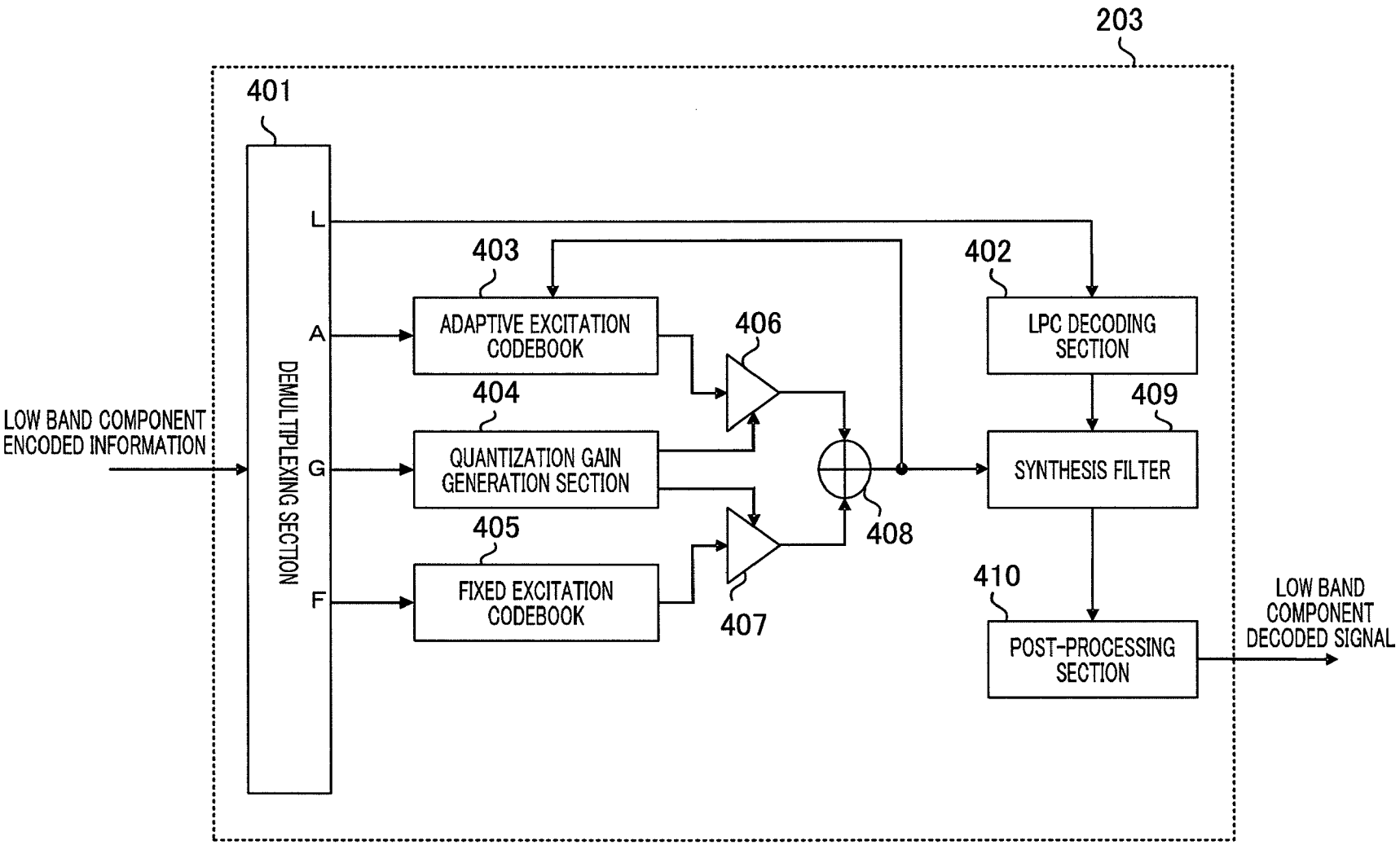
FIG. 4 is a block diagram showing an internal configuration of the low band decoding section shown in FIG. 2.

Next, an internal configuration of low band decoding section 203 shown in FIG. 2 will be explained using FIG. 4. Here, a case where low band decoding section 203 performs CELP type speech decoding will be explained.

Demultiplexing section 401 divides the low band component encoded information outputted from low band encoding section 202 into individual codes (L), (A), (G) and (F). The divided LPC code (L) is outputted to LPC decoding section 402, the divided adaptive excitation vector code (A) is outputted to adaptive excitation codebook 403, the divided quantization gain code (G) is outputted to quantization gain generation section 404 and the divided fixed excitation vector code (F) is outputted to fixed excitation codebook 405.

LPC decoding section 402 decodes the quantized LPC from the code (L) outputted from demultiplexing section 401, and outputs the decoded quantized LPC to synthesis filter 409.

Adaptive excitation codebook 403 extracts one frame of samples from the past excitation specified by the adaptive excitation vector code (A) outputted from demultiplexing section 401 as an adaptive excitation vector and outputs the adaptive excitation vector to multiplication section 406.

Quantization gain generation section 404 decodes the quantization adaptive excitation gain and quantization fixed excitation gain specified by the quantization gain code (G) outputted from demultiplexing section 401, outputs the quantization adaptive excitation gain to multiplication section 406 and outputs the quantization fixed excitation gain to multiplication section 407.

Fixed excitation codebook 405 generates a fixed excitation vector specified by the fixed excitation vector code (F) outputted from demultiplexing section 401, and outputs the fixed excitation vector to multiplication section 407.

Multiplication section 406 multiplies the adaptive excitation vector outputted from adaptive excitation codebook 403 by the quantization adaptive excitation gain outputted from quantization gain generation section 404, and outputs the multiplication result to addition section 408. Furthermore, multiplication section 407 multiplies the fixed excitation vector outputted from fixed excitation codebook 405 by the quantization fixed excitation gain outputted from quantization gain generation section 404, and outputs the multiplication result to addition section 408.

Addition section 408 adds up the adaptive excitation vector multiplied by the gain outputted from multiplication section 406 and the fixed excitation vector multiplied by the gain outputted from multiplication section 407 to generate an excitation, and outputs the excitation to synthesis filter 409 and adaptive excitation codebook 403.

Synthesis filter 409 performs a filter synthesis of the excitation outputted from addition section 408 using the filter coefficient decoded by LPC decoding section 402, and outputs the synthesized signal to post-processing section 410.

Post-processing section 410 applies processing for improving the subjective quality of speech such as formant emphasis and pitch emphasis and processing for improving the subjective quality of stationary noise, to the signal outputted from synthesis filter 409, and outputs the resulting signal to up-sampling processing section 204 as a low band component decoded signal.

Figure 5:
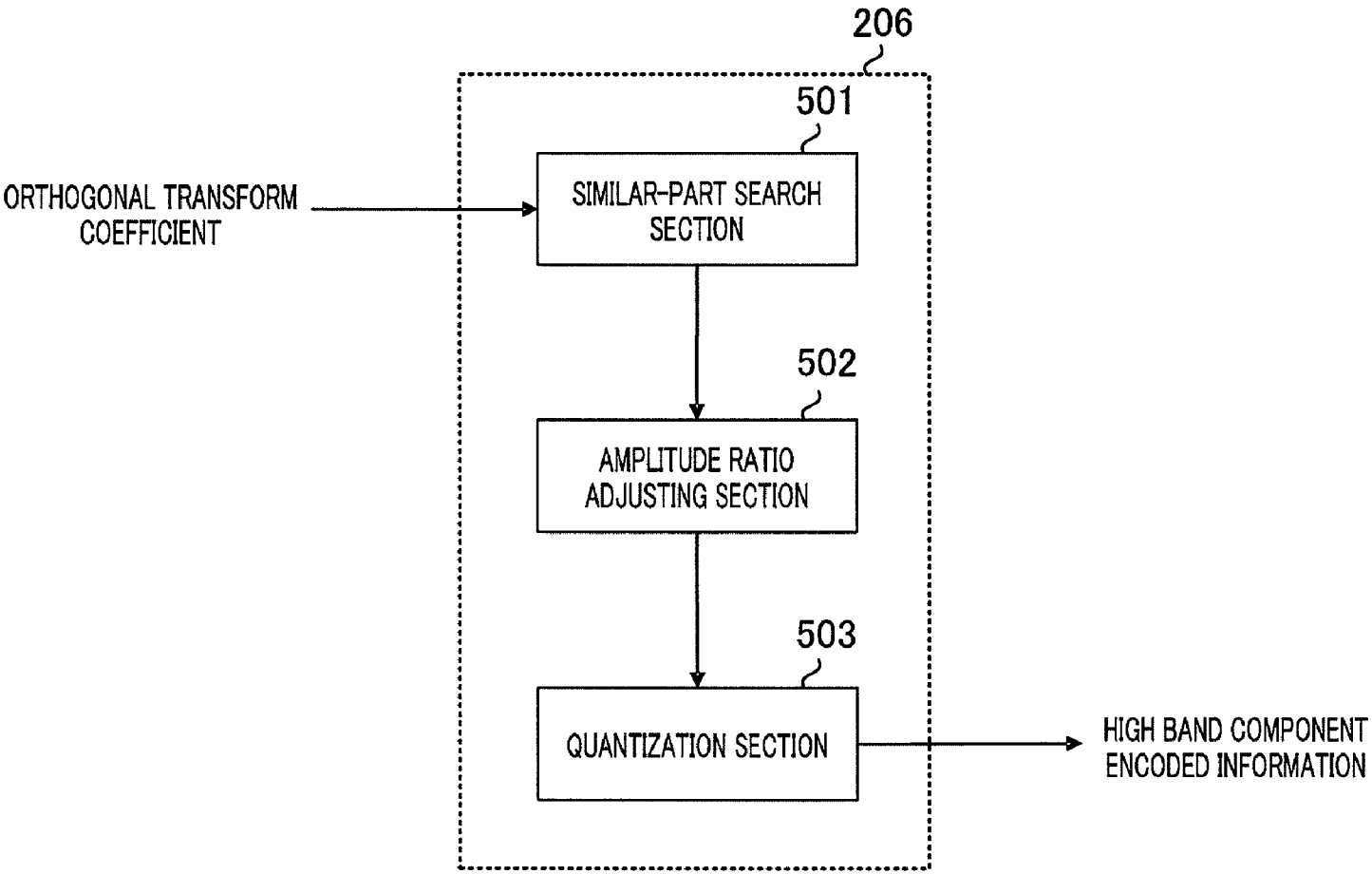
FIG. 5 is a block diagram showing an internal configuration of the high band encoding section shown in FIG. 2.

Next, an internal configuration of high band encoding section 206 shown in FIG. 2 will be explained using FIG. 5. A similar-part search section 501 calculates the search result position $t_{MIN}$ ($t=t_{MIN}$) by minimizing the error D between M samples of MDCT coefficients $Y_k$ of the up-sampled low band component decoded signal outputted from orthogonal transform processing section 205 and MDCT coefficients $X_k$ of the input signal outputted from orthogonal transform processing section 205. Similar-part search section 501 may also calculate the gain β at $t_{min}$. The error D and gain β can be calculated from equation 9 and equation 10, respectively.

(Equation 9)

$$D = \sum_{i=0}^{M-1} X^i \cdot X^i - \frac{\left(\sum_{i=0}^{M-1} X^i \cdot Y_t^i\right)^2}{\sum_{i=0}^{M-1} Y_t^i \cdot Y_t^i} \quad [9]$$

(Equation 10)

$$\beta = \frac{\sum_{i=0}^{M-1} X^i \cdot Y_{t_{MIN}}^i}{\sum_{i=0}^{M-1} Y_{t_{MIN}}^i \cdot Y_{t_{MIN}}^i} \quad [10]$$

In equation 9 and 10, $Y_{ti}$ is the t-th MDCT coefficients sample counting from the i-th sample of the index of MDCT coefficients Y; $Y_{ti\ MIN}$ is the $t_{MIN}$ MDCT coefficients sample counting from the i-th sample of the index of MDCT coefficients Y; D is the error between MDCT coefficients Y and MDCT coefficients X, as calculated by equation 9; M is the number of MDCT coefficients (e.g., the number of samples) to use to calculate the error D between $Y_{ti}$ and $X_i$. In addition, M is an integer equal to or greater than 2, t has a range from 0 to N−1 (i.e., similar to k as described in equation 3) and i has a range from 0 to M−1. Stated differently, according to equation 9, an error D is calculated error between MDCT coefficients $Y_{ti}$ and $X_i$ with respect to M samples (e.g., M samples may be taken from the beginning of a frame). The MDCT coefficients $Y_{ti}$ varies by variable t in the calculation and D is calculated in accordance with the value of t. The minimum error (as calculated by D) between M samples is determined as $t_{MIN}$— where $Y_{itMIN}$ represents the $t_{MIN}$-th MDCT coefficient samples among MDCT coefficients $Y_i$. In equation 10, the $t_{MIN}$-th MDCT coefficient samples are used to calculate gain β.

Figure 6A:
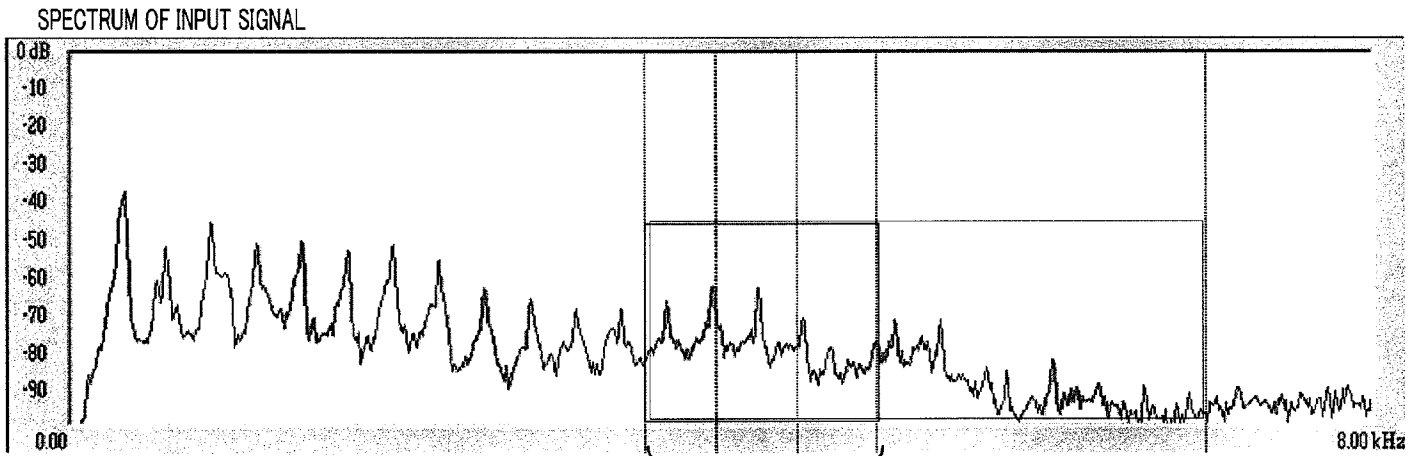
FIG. 6 shows, conceptually, a similar-part search by the a similar-part search section shown in FIG. 5.
Figure 6B:
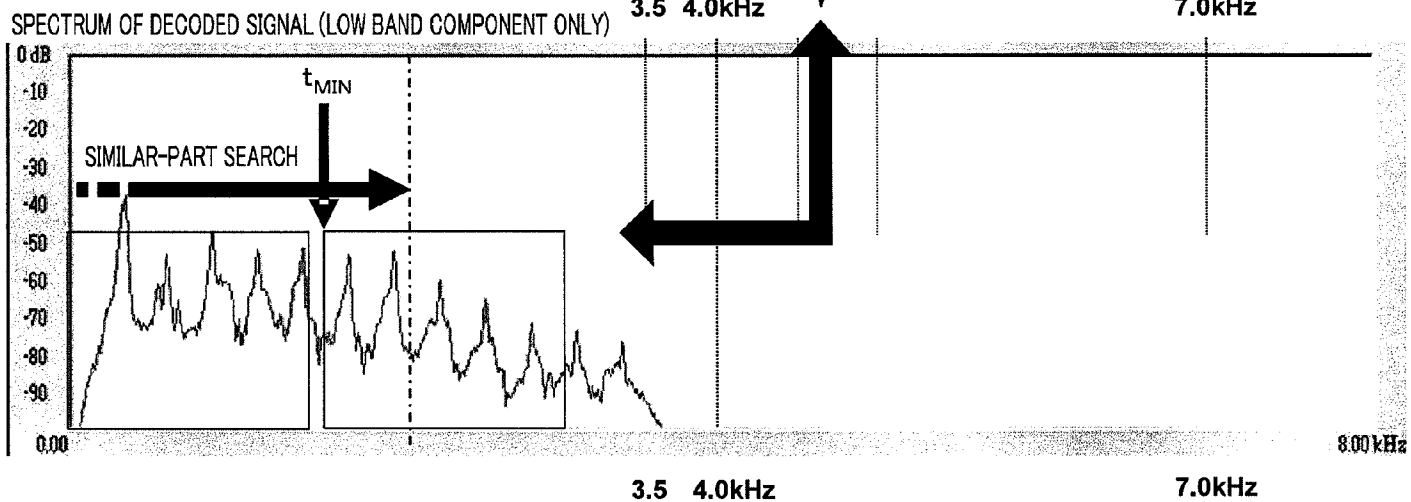

Here, FIG. 6A and FIG. 6B conceptually show a similar-part search by a similar-part search section 501. FIG. 6A shows an input signal spectrum, and shows the beginning part of the high band region (3.5 kHz to 7.0 kHz) of the input signal in a frame. FIG. 6B shows a situation in which a spectrum similar to the spectrum inside the frame shown in FIG. 6A is searched for sequentially from the beginning of the low band region of a decoded signal.

A similar-part search section 501 outputs MDCT coefficients $X_k$ of the input signal, MDCT coefficients $Y_k$ of the up-sampled low band component decoded signal, and calculated search result position $t_{MIN}$ and gain β, to amplitude ratio adjusting section 502.

Amplitude ratio adjusting section 502 extracts the part from search result position $t_{MIN}$ to $SR_{base}/SR_{input}\times(N-1)$ (if $X_k$ becomes zero in the middle, the part up the position before $X_k$ becomes zero), from MDCT coefficients $Y_k$ of an up-sampled low band component decoded signal, and multiplies this part by gain β and designates the resulting value as copy source spectral data $Z1_k$, expressed by equation 11.

(Equation 11)

$$Z1_k = Y_k \cdot \beta \ (k = t_{MIN}, \ldots, SR_{base}/SR_{input} \cdot N-1) \quad [11]$$

Next, amplitude ratio adjusting section 502 generates temporary spectral data $Z2_k$ from copy source spectral data $Z1_k$. To be more specific, amplitude ratio adjusting section 502 divides the length $((1-SR_{base}/SR_{input})\times N)$ of the spectral data of the high band component by the length $(SR_{base}/SR_{input}\times N-1-t_{MIN})$ of copy source spectral data $Z1_k$, repeats copying the source spectral data $Z1_k$ a number of times equaling the quotient such that source spectral data $Z1_k$ continues from the part of $k=SR_{base}/SR_{input}\times N-1$ of temporary spectral data $Z2_k$, and then copies copy source spectral data $Z1_k$ for a number of samples equaling the samples of the remainder after dividing the length $((1-SR_{base}/SR_{input})\times N)$ of the spectral data of the high band component by the length $(SR_{base}/SR_{input}\times N-1-t_{MIN})$ of copy source spectral data $Z1_k$, from the beginning of copy source spectral data $Z1_k$, to the tail end of temporary spectral data $Z2_k$.

Furthermore, suppose, when $X_k$ becomes zero in the middle, amplitude ratio adjusting section 502 adds the length of the part where $X_k$ is zero to the length $((1-SR_{base}/SR_{input})\times N)$ of the spectral data of the aforementioned high band component, and starts copying copy source spectral data $Z1_k$ to temporary spectral data $Z2_k$ from the part where $X_k$ is zero in the middle.

Next, amplitude ratio adjusting section 502 adjusts the amplitude ratio of temporary spectral data $Z2_k$. To be more specific, amplitude ratio adjusting section 502 divides MDCT coefficients $X_k$ of the input signal and the high band component $(k=SR_{base}/SR_{input}\times N, \ldots, N-1)$ of temporary spectral data $Z2_k$ into a plurality of bands first.

Here, a case where temporary spectral data $Z2_k$ is copied from the part of $k=SR_{base}/SR_{input}\times N$ in the aforementioned processing, will be explained. Amplitude ratio adjusting section 502 calculates amplitude ratio $\alpha_j$ for each band as expressed by equation 12 for MDCT coefficients $X_k$ of the input signal and the high band component of temporary spectral data $Z2_k$. In equation 12, suppose "NUM_BAND" is the number of bands and "band_index(j)" is the minimum sample index out of the indexes making up band j.

(Equation 12)

$$\alpha_j = \sqrt{\frac{\sum_{k=\text{band_index}(j)}^{\text{band_index}(j+1)-1} X_k}{\sum_{k=\text{band_index}(j)}^{\text{band_index}(j+1)-1} Z2_k}} \quad (j = 0, \ldots, \text{NUM_BAND} - 1) \qquad [12]$$

Figure 7:
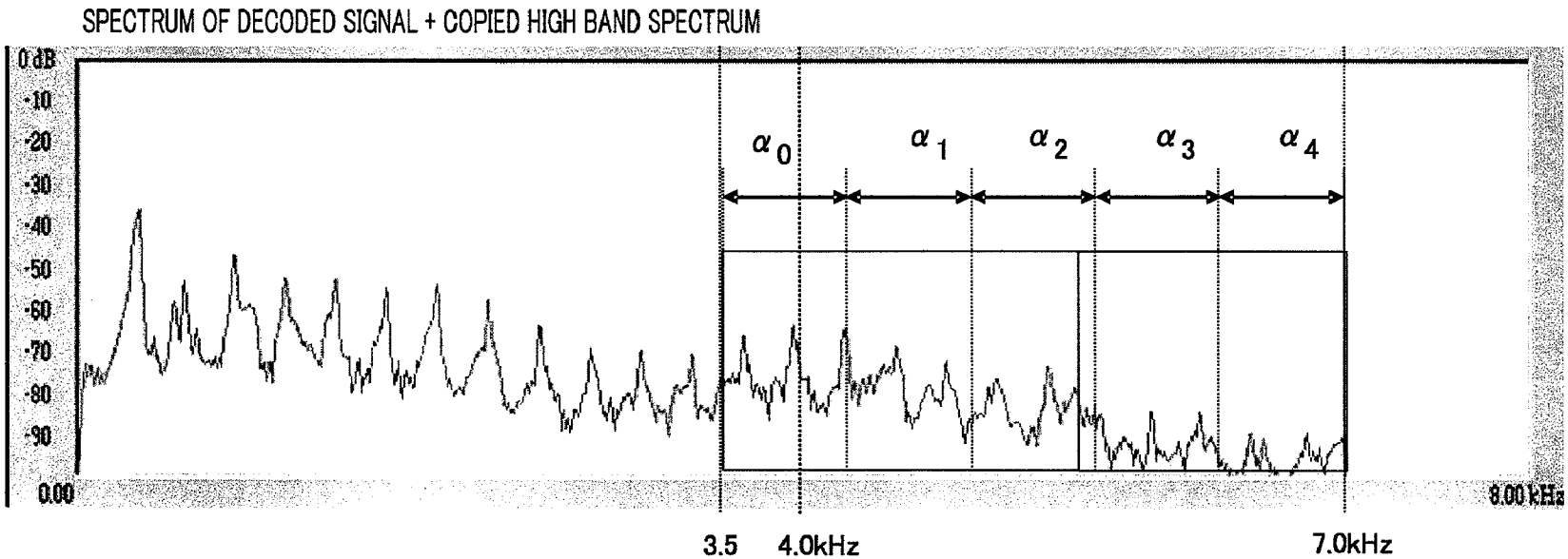
FIG. 7 shows, conceptually, the processing in the amplitude ratio adjusting section shown in FIG. 5.

FIG. 7 shows, conceptually, the processing in amplitude ratio adjusting section 502. FIG. 7 shows a situation in which the spectrum of the high band region is generated based on the similar-part searched from the low band region in FIG. 6(*b*) (when NUM_BAND=5).

Amplitude ratio adjusting section 502 outputs amplitude ratio $\alpha_j$ for each band obtained from equation 12, search result position $t_{MIN}$ and gain $\beta$ to quantization section 503.

Quantization section 503 quantizes amplitude ratio $\alpha_j$ for each band, search result position $t_{MIN}$ and gain $\beta$ outputted from amplitude ratio adjusting section 502 using codebooks provided in advance and outputs the index of each codebook, to encoded information integration section 207 as a high band component encoded information.

Here, suppose amplitude ratio $\alpha_j$ for each band, search result position $t_{MIN}$ and gain $\beta$ are quantized all separately and the selected codebook indexes are code_A, code_T and code_B, respectively. Furthermore, a quantization method is employed here whereby the code vector (or code) having the minimum distance (i.e. square error) to the quantization target is selected from the codebooks. However, this quantization method is in the public domain and will not be described in detail.

Figure 8:
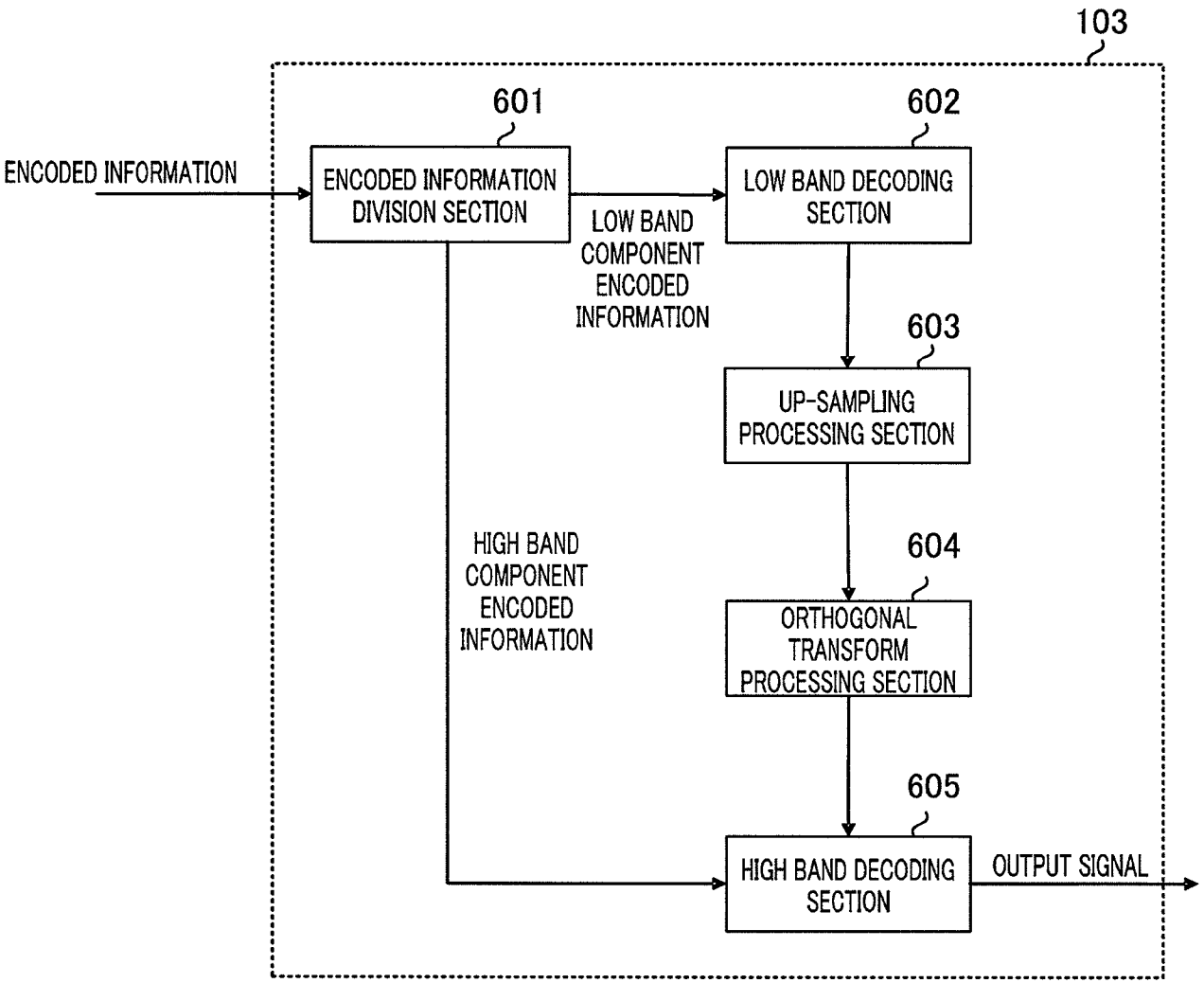
FIG. 8 is a block diagram showing a configuration of the decoding apparatus shown in FIG. 1.

FIG. 8 is a block diagram showing an internal configuration of decoding apparatus 103 shown in FIG. 1. Encoded information division section 601 divides the low band component encoded information and the high band component encoded information from the inputted encoded information, outputs the divided low band component encoded information to low band decoding section 602, and outputs the divided high band component encoded information to high band decoding section 605.

Low band decoding section 602 decodes the low band component encoded information outputted from encoded information division section 601 using a CELP type speech decoding method, to generate a low band component decoded signal and outputs the low band component decoded signal generated to up-sampling processing section 603. Since the configuration of low band decoding section 602 is the same as that of aforementioned low band decoding section 203, its detailed explanations will be omitted.

Up-sampling processing section 603 up-samples the sampling frequency of the low band component decoded signal outputted from low band decoding section 602 from $SR_{base}$ to $SR_{input}$, and outputs the up-sampled low band component decoded signal to orthogonal transform processing section 604 as the up-sampled low band component decoded signal.

Orthogonal transform processing section 604 applies orthogonal transform processing (MDCT) to the up-sampled low band component decoded signal outputted from up-sampling processing section 603, calculates MDCT coefficients $Y'_k$ of the up-sampled low band component decoded signal and outputs this MDCT coefficients $Y'_k$ to high band decoding section 605. The configuration of orthogonal transform processing section 604 is the same as that of aforementioned orthogonal transform processing section 205, and therefore detailed explanations thereof will be omitted.

High band decoding section 605 generates a signal including the high band component from MDCT coefficients $Y'_k$ of the up-sampled low band component decoded signal outputted from orthogonal transform processing section 604 and the high band component encoded information outputted from encoded information division section 601, and makes this the output signal.

Figure 9:
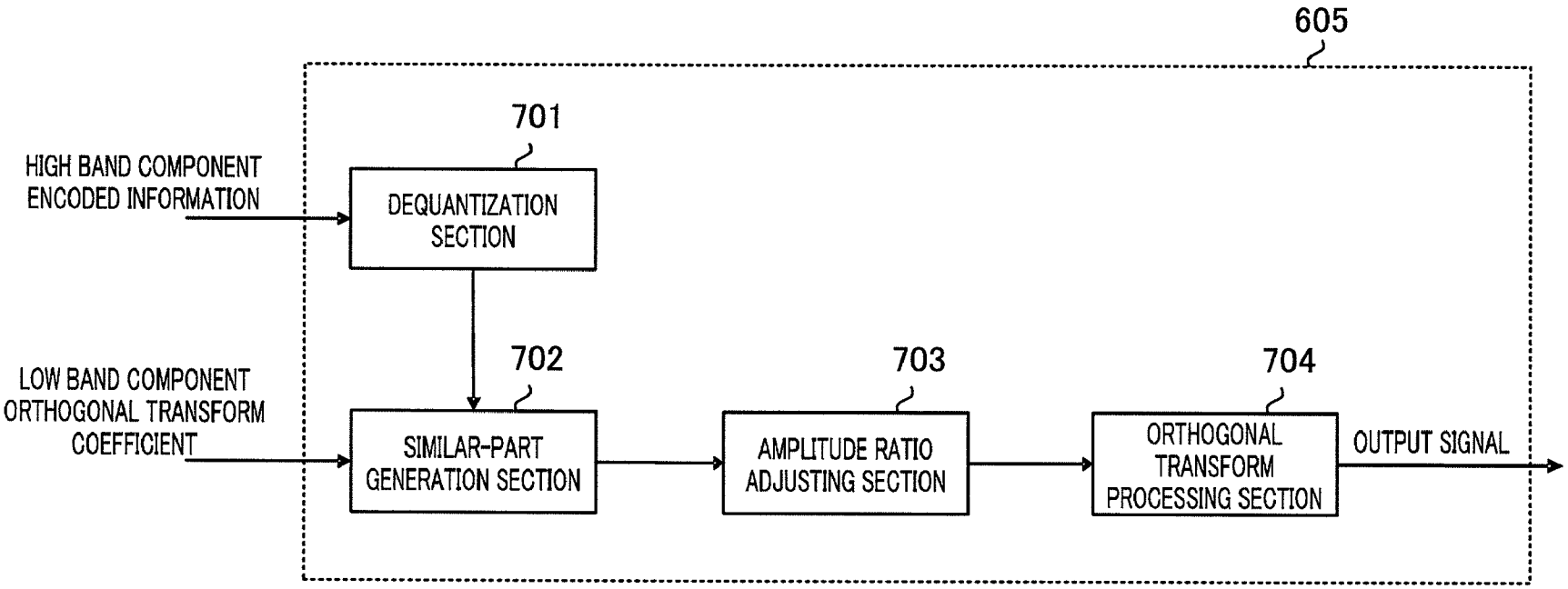
FIG. 9 is a block diagram showing an internal configuration of the high band decoding section shown in FIG. 8.

Next, an internal configuration of high band decoding section 605 shown in FIG. 8 will be explained using FIG. 9. Dequantization section 701 dequantizes the high band component encoded information (i.e. code_A, code_T and code_B) outputted from encoded information division section 601 for the codebooks provided in advance, and outputs amplitude ratio $\alpha_j$ for each band produced, search result position $t_{MIN}$ and gain $\beta$, to similar-part generation section 702. To be more specific, the vectors and values indicated by the high band component encoded information (i.e. code_A, code_T and code_B) from each codebook are outputted to similar-part generation section 702 as amplitude ratio $\alpha_j$ for each band, search result position $t_{MIN}$ and gain $\beta$, respectively. Here, suppose amplitude ratio $\alpha_j$ for each band, search result position $t_{MIN}$ and gain $\beta$ are dequantized using different codebooks as in the case of quantization section 503.

Similar-part generation section 702 generates a high band component ($k=SR_{base}/SR_{input}\times N, \ldots, N-1$) of MDCT coefficients Y' from MDCT coefficients $Y'_k$ of the up-sampled low band component outputted from orthogonal transform processing section 604 and search position result $t_{MIN}$ outputted from dequantization section 701 and gain $\beta$. To be more specific, copy source spectral data $Z1'_k$ is generated according to equation 13.

(Equation 13)

$$Z1'_k = Y'_k \cdot \beta \ (k = t_{MIN}, \ldots, SR_{base}/SR_{input} \cdot N - 1) \qquad [13]$$

Furthermore, suppose, when $Y'_k$ is zero in the middle, copy source spectral data $Z1'_k$ covers the part from the position where k is $t_{MIN}$ up to the position before $Y'_k$ becomes zero, according to equation 13.

Next, similar-part generation section 702 generates temporary spectral data $Z2'_k$ from copy source spectral data $Z1'_k$ calculated according to equation 13. To be more specific, similar-part generation section 702 divides the length $((1-SR_{base}/SR_{input})\times N)$ of the spectral data of the high band component by the length $(SR_{base}/SR_{input}\times N-1-t_{MIN})$ of copy source spectral data $Z1'_k$, repeats copying copy source spectral data $Z1'_k$ a number of time equaling the quotient such that copy source spectral data $Z1'_k$ continues from the part of $k=SR_{base}/SR_{input}\times N-1$ of temporary spectral data $Z2'_k$, and then copies copy source spectral data $Z1'_k$ for a number of samples equaling the samples of the remainder after dividing the length $((1-SR_{base}/SR_{input})\times N)$ of the spectral data of the high band component by the length $(SR_{base}/SR_{input}\times N-1-t_{MIN})$ of copy source spectral data $Z1'_k$ from the beginning of copy source spectral data $Z1'_k$ to the tail end of temporary spectral data $Z2'_k$.

Furthermore, suppose, when $Y'_k$ becomes zero in the middle, similar-part generation section 702 adds the length of the part where $Y'_k$ is zero, to the length $((1-SR_{base}/SR_{input})\times N)$ of the spectral data of the aforementioned high band component, and starts copying copy source spectral data $Z1'_k$ to temporary spectral data $Z2'_k$ from the part where $Y'_k$ is zero in the middle.

Next, similar-part generation section 702 copies the value of the low band component of $Y'_k$ to the low band component of temporary spectral data $Z2'_k$, expressed by equation 14. Here, a case where the temporary spectral data $Z2'_k$ is copied from the part of $k=SR_{base}/SR_{input}\times N$ in the aforementioned processing, will be explained.

(Equation 14)

$$Z2'_k=Y'_k(k=0,\ldots,SR_{base}/SR_{input}\cdot N-1) \quad [14]$$

Similar-part generation section 702 outputs the calculated temporary spectral data $Z2'_k$ and amplitude ratio $\alpha_j$ per band, to amplitude ratio adjusting section 703.

Amplitude ratio adjusting section 703 calculates temporary spectral data $Z3'_k$ from temporary spectral data $Z2'_k$ and amplitude ratio $\alpha_j$ for each band outputted from similar-part generation section 702, expressed by equation 15. Here, $\alpha_j$ in equation 15 is the amplitude ratio of each band and band_index(j) is the minimum sample index in the indexes making up band j.

(Equation 15)

$$Z3'_k=\begin{cases} Z2'_k & (k=0,\ldots,SR_{base}/SR_{input}\cdot N-1) \\ Z2'_k\cdot\alpha_j(k=SR_{base}/SR_{input}\cdot N,\ldots,N-1: \\ \text{band_index}(j)\le k<\text{band_index}(j+1)) \\ (j=0,\ldots,\text{NUM_BAND}-1) \end{cases} \quad [15]$$

Amplitude ratio adjusting section 703 outputs temporary spectral data $Z3'_k$ calculated according to equation 15 to orthogonal transform processing section 704.

Orthogonal transform processing section 704 contains buffer $buf'_k$ and is initialized according to equation 16.

(Equation 16)

$$buf'_k=0\ (k=0,\ldots,N-1) \quad [16]$$

Orthogonal transform processing section 704 calculates decoded signal $Y''_n$ using temporary spectral data $Z3'_k$ outputted from amplitude ratio adjusting section 703, according to equation 17.

(Equation 17)

$$Y''_n=\frac{2}{N}\sum_{n=0}^{2N-1}Z3''_k\cos\left[\frac{(2n+1+N)}{(2k+1)\pi}\right](n=0,\ldots,N-1) \quad [17]$$

Here, $Z3''_k$ is a vector combining temporary spectral data $Z3'_k$ and buffer $buf'_k$ and is calculated according to equation 18.

(Equation 18)

$$Z3'_k=\begin{cases} buf'_k & (k=0,\ldots N-1) \\ Z3'_k & (k=N,\ldots 2N-1) \end{cases} \quad [18]$$

Next, orthogonal transform processing section 704 updates buffer $buf'_k$ according to equation 19.

(Equation 19)

$$buf'_k=Z3'_k\ (k=0,\ldots,N-1) \quad [19]$$

Orthogonal transform processing section 704 obtains decoded signal $Y''_n$ as an output signal.

In this way, in accordance with Embodiment 1, to generate spectral data of the high band region of a signal to be encoded based on spectral data of the low band region of the signal, a similar-part search is performed for a part (e.g. beginning part) in the spectral data of the high band region, in the quantized low band region, and spectral data of the high band region is generated based on the search result, so that it is possible to encode spectral data of the high band region of a wideband signal based on spectral data of the low band region with an extremely small amount of information and amount of calculation processing, and, furthermore, obtain a decoded signal of high quality even when a significant quantization distortion occurs in the spectral data of the low band region.

Embodiment 2

Embodiment 1 has explained a method of performing a similar-part search with respect to MDCT coefficients of up-sampled low band component decoded signal, and the beginning part of high band components of MDCT coefficients of an input signal, and calculating parameters for generating MDCT coefficients for the high band component at the time of decoding. Now, with embodiment 2, a weighted similar-part search method will be described, whereby, in high band components of the MDCT coefficients of an input signal, lower band components are regarded more important.

Since the communication system according to Embodiment 2 is similar to the configuration of Embodiment 1 shown in FIG. 1, FIG. 1 will be used, and furthermore, since the encoding apparatus according to Embodiment 2 of the present invention is similar to the configuration of Embodiment 1 shown in FIG. 2, FIG. 2 will be used and overlapping explanations will be omitted. However, in the configuration shown in FIG. 2, high band encoding section 206 has a function different from that in Embodiment 1, and therefore high band encoding section 206 will be explained using FIG. 5.

Similar-part search section 501 calculates a search result position $t_{MIN}$ ($t=t_{MIN}$) when error D2 between MDCT coefficients $Y_k$ of an up-sampled low band component decoded signal outputted from orthogonal transform processing section 205 and M (M is an integer equal to or greater than 2) samples from the beginning of MDCT coefficients $X_k$ of the input signal outputted from orthogonal transform processing section 205 becomes a minimum, and gain $\beta$2 at that moment. Error D2 and $\beta$2 are calculated according to equation 20 and equation 21, respectively.

(Equation 20)

$$D2 = \left( \sum_{i=0}^{M-1} X^i \cdot X^i - \frac{\left( \sum_{i=0}^{M-1} X^i \cdot Y_t^i \right)^2}{\sum_{i=0}^{M-1} Y_t^i \cdot Y_t^i} \right) \cdot W_i \quad [20]$$

(Equation 21)

$$\beta 2 = \frac{\sum_{i=0}^{M-1} X^i \cdot Y_{t_{MIN}}^i}{\sum_{i=0}^{M-1} Y_{t_{MIN}}^i \cdot Y_{t_{MIN}}^i} \quad [21]$$

Here, $W_i$ in equation 20 is a weight having a value of about 0.0 to 1.0, and is multiplied when error D2 (i.e. distance) is calculated. To be more specific, a smaller error sample index (that is, an MDCT coefficients of a lower band region), is assigned a greater weight. An example of $W_i$ is shown in equation 22.

(Equation 22)

$$W_i = -\frac{0.5}{M-1} i + 1.0 \ (i = 0, \ldots, M-1, M \geq 2) \quad [22]$$

In this way, by calculating the distance using a greater weight for MDCT coefficients of lower band, it is possible to realize a search placing the emphasis on the distortion in the part connecting the low band component and the high band component.

The configurations of amplitude ratio adjusting section 502 and quantization section 503 are the same as those for the processing explained in Embodiment 1, and therefore detailed explanations thereof will be omitted.

Encoding apparatus 101 has been explained so far. The configuration of decoding apparatus 103 is the same as explained in Embodiment 1, and therefore detailed explanations thereof will be omitted.

In this way, in accordance with Embodiment 2, to generate spectral data of the high band region of a signal to be encoded based on spectral data of the low band region of the signal, the distance is calculated by assigning greater weights to smaller error sample indexes, a similar-part search for part (i.e. beginning part) of spectral data of the high band region is performed in spectral data of the quantized low band region and spectral data of the high band region is generated based on the result of the search, so that it is possible to encode spectral data of the high band region of a wideband signal in high perceptual quality based on spectral data of the low band region of the signal and furthermore obtain a decoded signal of high quality even when a significant quantization distortion occurs in the spectral data of the low band region.

The present embodiment has explained a case where, to generate spectral data of the high band region of a signal to be encoded based on spectral data of the low band region of the signal, a similar-part search for a part (i.e. beginning part) of the spectral data of the high band region is performed in the spectral data of the quantized low band region, so that the present invention is not limited to this and it is equally possible to adopt the above-described weighting in distance calculation for the entire part of the spectral data of the high band region.

Furthermore, although the present embodiment has explained a method of generating spectral data of the high band region of a signal to be encoded is generated based on spectral data of the low band region of the signal, by calculating the distance by assigning greater weights to smaller error sample indexes, performing a similar-part search for a part (i.e. beginning part) of the spectral data of the high band region in spectral data of the quantized low band region, and generating spectral data of the high band region based on the result of the search, but the present invention is by no means limited to this and may likewise adopt a method of introducing the length of copy source spectral data as an evaluation measure during a search. To be more specific, by making a search result that increases the length of the copy source spectral data, that is, by making an entry of a search position of a low band more likely to be selected, it is possible to further improve the quality of an output signal by reducing the number of discontinuous parts caused when the spectral data of the high band region is copied a plurality of times and placing the discontinuous parts in high frequency bands.

The above-described embodiments have explained that the index of the MDCT coefficients of the spectral data of the high band region generated starts from $SR_{base}/SR_{input} \times (N-1)$, but the present invention is not limited to this, and the present invention is also applicable to cases where spectral data of the high band region is generated likewise from a part where low band spectral data becomes zero, irrespective of sampling frequencies. Furthermore, the present invention is also applicable to a case where spectral data of the high band region is generated from an index specified from the user and system side.

The above-described embodiments have explained the CELP type speech encoding scheme in the low band encoding section as an example, but the present invention is not limited to this and is also applicable to cases where a down-sampled input signal is coded according to a speech/sound encoding scheme other than CELP type. The same applies to the low band decoding section.

The present invention is further applicable to a case where a signal processing program is recorded or written into a mechanically readable recording medium such as a memory, disk, tape, CD, DVD and operated, and operations and effects similar to those of the present embodiment can be obtained.

Each function block employed in the description of each of the aforementioned embodiments may typically be implemented as an LSI constituted by an integrated circuit. These may be individual chips or partially or totally contained on a single chip.

"LSI" is adopted here but this may also be referred to as "IC", "system LSI", "super LSI", or "ultra LSI" depending on differing extents of integration.

Further, the method of circuit integration is not limited to LSI's, and implementation using dedicated circuitry or general purpose processors is also possible. After LSI manufacture, utilization of an FPGA (Field Programmable Gate Array) or a reconfigurable processor where connections and settings of circuit cells within an LSI can be reconfigured is also possible.

Further, if integrated circuit technology comes out to replace LSI's as a result of the advancement of semiconductor technology or a derivative other technology, it is naturally also possible to carry out function block integration using this technology. Application of biotechnology is also possible.

The disclosures of Japanese Patent Application No. 2006-131852, filed on May 10, 2006, and Japanese Patent Application No. 2007-047931, filed on Feb. 27, 2007, including the specifications, drawings and abstracts, are incorporated herein by reference in their entirety.

INDUSTRIAL APPLICABILITY

The encoding apparatus and encoding method according to the present invention make it possible to encode spectral data of the high band region of a wideband signal based on spectral data of the low band region of the signal and produce a decoded signal of high quality even when a significant quantization distortion occurs in the spectral data of the low band region, and are therefore applicable for use in, for example, a packet communication system and mobile communication system.

The invention claimed is:

1. An encoding apparatus, comprising:

a first encoder, comprising one of a first circuit and a first processor, that encodes an input signal to generate first encoded information;

a decoder, comprising one of a second circuit and a second processor, that decodes the first encoded information to generate a decoded signal;

an orthogonal transformer, comprising one of a third circuit and a third processor, that orthogonal-transforms the input signal and the decoded signal to generate orthogonal transform coefficients for the input signal and the decoded signal;

a second encoder, comprising one of a fourth circuit and a fourth processor, that generates second encoded information representing a high band part in the orthogonal transform coefficients of the decoded signal, based on the orthogonal transform coefficients of the input signal and the orthogonal transform coefficients of the decoded signal; and an integrator, comprising one of a fifth circuit and a fifth processor, that integrates the first encoded information and the second encoded information, wherein the input signal comprises at least one of an input speech signal and an input sound signal, and the decoded signal comprises at least one of a decoded speech signal and a decoded sound signal.

2. The encoding apparatus according to claim 1, wherein the second encoder searches for a part that is most similar to an orthogonal transform coefficient of the input signal, in the orthogonal transform coefficients of the decoded signal.

3. The encoding apparatus according to claim 2, wherein the second encoder calculates a first orthogonal transform coefficient using a search result of the second encoder and adjusts an amplitude of the first orthogonal transform coefficient so that the amplitude of the first orthogonal transform coefficient is equal to an amplitude of the orthogonal transform coefficient of the input signal.

4. The encoding apparatus according to claim 1, wherein the second encoder searches for a first part that is most similar to a second part of the orthogonal transform coefficients of the input signal, in the orthogonal transform coefficients of the decoded signal.

5. The encoding apparatus according to claim 1, wherein the first encoder performs encoding using a CELP type encoding method.

6. The encoding apparatus according to claim 1, wherein the second encoder multiplies a difference between a first orthogonal transform coefficient of the input signal and a second orthogonal transform coefficient of the decoded signal by a greater weight for a low frequency region, and, using a multiplication result, searches for a part that is most similar to the orthogonal transform coefficients of the input signal, in the orthogonal transform coefficients of the decoded signal.

7. The encoding apparatus according to claim 1, wherein the second encoder multiplies a difference between a first orthogonal transform coefficient of the input signal and a first orthogonal transform coefficient of the decoded signal by a weight that causes entries on a low frequency band to be selected as a search position, and, using a multiplication result, searches for a part that is most similar to the orthogonal transform coefficients of the input signal, in the orthogonal transform coefficients of the decoded signal.

8. An encoding method, performed by a processor, comprising:

encoding, by the processor, an input signal to generate first encoded information;

decoding, by the processor, the first encoded information to generate a decoded signal;

orthogonal-transforming, by the processor, the input signal and the decoded signal to generate orthogonal transform coefficients for the input signal and the decoded signal;

generating, by the processor, second encoded information representing a high band part of the orthogonal transform coefficients of the decoded signal based on the orthogonal transform coefficients of the input signal and the orthogonal transform coefficients of the decoded signal; and integrating, by the processor, the first encoded information and the second encoded information wherein the input signal comprises at least one of an input speech signal and an input sound signal, and the decoded signal comprises at least one of a decoded speech signal and a decoded sound signal.

9. A non-transitory computer-readable medium including an encoding program for executing an encoding on a computer, the encoding program comprising:

encoding, by the computer, an input signal to generate first encoded information;

decoding, by the computer, the first encoded information to generate a decoded signal;

orthogonal-transforming, by the computer, the input signal and the decoded signal to generate orthogonal transform coefficients for the input signal and the decoded signal;

generating, by the computer, second encoded information representing a high band part of the orthogonal transform coefficients of the decoded signal based on the orthogonal transform coefficients of the input signal and the orthogonal transform coefficients of the decoded signal; and integrating, by the computer, the first encoded information and the second encoded information, wherein the input signal comprises at least one of an input speech signal and an input sound signal, and the decoded signal comprises at least one of a decoded speech signal and a decoded sound signal.

* * * * *